US012453445B2

(12) United States Patent
Erzen

(10) Patent No.: US 12,453,445 B2
(45) Date of Patent: Oct. 28, 2025

(54) ROLLER ASSEMBLY WITH COMPLIANT MECHANISMS

(71) Applicant: Kimberly-Clark Worldwide, Inc., Neenah, WI (US)

(72) Inventor: Klemen Erzen, Preddvor (SI)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 18/724,039

(22) PCT Filed: Jan. 14, 2022

(86) PCT No.: PCT/US2022/012528
§ 371 (c)(1),
(2) Date: Jun. 25, 2024

(87) PCT Pub. No.: WO2023/136832
PCT Pub. Date: Jul. 20, 2023

(65) Prior Publication Data
US 2024/0415339 A1 Dec. 19, 2024

(51) Int. Cl.
*A47K 10/38* (2006.01)

(52) U.S. Cl.
CPC ..... *A47K 10/38* (2013.01)

(58) Field of Classification Search
CPC ..... A47K 10/38
See application file for complete search history.

(56) References Cited

U.S. PATENT DOCUMENTS 2,512,900 A * 6/1950 Kwitek ..... B65H 19/29 242/532.3
2,873,927 A * 2/1959 McDonald ..... A47K 10/36 242/596.7
4,119,251 A * 10/1978 Golner ..... B65H 35/002 225/53
4,660,781 A 4/1987 Hazard
5,302,167 A * 4/1994 Kley ..... B31F 1/07 493/400
6,363,824 B1 * 4/2002 Granger ..... A47K 10/3643 83/337
6,607,160 B2 * 8/2003 Lewis ..... A47K 10/3637 242/565

(Continued)

FOREIGN PATENT DOCUMENTS

CN 1117263 A 2/1996
CN 102231960 A 11/2011

(Continued)

OTHER PUBLICATIONS

PCT Search Report Corresponding to Application No. PCT/US2022/012528 on Apr. 20, 2022.

(Continued)

*Primary Examiner* — Gene O Crawford
*Assistant Examiner* — Kelvin L Randall, Jr.
(74) *Attorney, Agent, or Firm* — Dority & Manning, P.A.

(57) ABSTRACT

A roller assembly for a dispenser includes an elongated guide body and a pair of pressure roller supports. A plurality of compliant support arms couple the pair of pressure roller supports to the elongated guide body. A plurality of compliant support spring members are configured to couple a Rapper bar to the elongated guide body.

16 Claims, 4 Drawing Sheets

(56) References Cited

U.S. PATENT DOCUMENTS

| | | | | |
|---|---|---|---|---|
| 7,398,944 | B2 * | 7/2008 | Lewis | A47K 10/36 250/221 |
| 7,506,869 | B2 | 3/2009 | Liu et al. | |
| 7,878,446 | B2 * | 2/2011 | Reinsel | A47K 10/36 242/564.4 |
| 8,220,684 | B1 * | 7/2012 | Keily | A47K 10/38 225/39 |
| 9,826,864 | B2 | 11/2017 | Bunnell | |
| 10,470,622 | B2 * | 11/2019 | Goeking | A47K 10/26 |
| 12,029,355 | B2 * | 7/2024 | Osborne, Jr. | B65H 35/0013 |
| 2003/0019971 | A1 | 1/2003 | Lewis et al. | |
| 2003/0183344 | A1 * | 10/2003 | Lai | B65H 35/0033 156/577 |
| 2006/0169827 | A1 * | 8/2006 | Lewis | A47K 10/36 242/563 |
| 2007/0194165 | A1 * | 8/2007 | Lee | B65H 35/0026 242/411 |
| 2008/0105780 | A1 * | 5/2008 | Reinsel | A47K 10/36 242/588.3 |
| 2009/0256022 | A1 | 10/2009 | Maurer | |
| 2010/0243696 | A1 * | 9/2010 | Friesen | A47K 10/36 225/10 |
| 2011/0308451 | A1 * | 12/2011 | Kaufmann | A47K 10/32 118/235 |
| 2013/0213203 | A1 * | 8/2013 | Bunnell | A47K 10/3612 83/211 |
| 2015/0368060 | A1 * | 12/2015 | Huang | B65H 35/008 225/20 |
| 2018/0002050 | A1 * | 1/2018 | Le Rigoleur | B65H 35/008 |
| 2019/0350414 | A1 | 11/2019 | Starkey | |
| 2020/0187728 | A1 * | 6/2020 | Osborne, Jr. | B65H 35/0013 |
| 2022/0039614 | A1 * | 2/2022 | Osborne, Jr. | A47K 10/3631 |
| 2023/0157491 | A1 * | 5/2023 | Lewis | A47K 10/38 221/26 |

FOREIGN PATENT DOCUMENTS

| | | | |
|---|---|---|---|
| CN | 102281808 | A | 12/2011 |
| CN | 105129488 | A | 12/2015 |
| CN | 109998625 | A | 7/2019 |
| DE | 102014106150 | B4 | 10/2016 |
| JP | 2012100773 | A | 5/2012 |
| JP | 3224159 | U | 11/2019 |
| KR | 20040066879 | A | 7/2004 |

OTHER PUBLICATIONS

Nerys, Today's 3D Print—Toilet Paper Holder I Created, YouTube, Accessed Apr. 15, 2021, 4 Pages, https://www.youtube.com/watch?v=hAPula4VSBc.

Chinese Search Report Corresponding to Application No. 202280087483.6 on Jan. 22, 2025.

* cited by examiner

ROLLER ASSEMBLY WITH COMPLIANT MECHANISMS

BACKGROUND

Various dispensers for paper products are known in the art. Certain dispensers include a pressure roller that engages paper from a paper roll within the dispenser. For instance, the pressure roller can urge paper on the paper roll against a motorized spindle. As the spindle rotates, the spindle may translate the free end of the paper on the paper roll out of the dispenser where the user can tear off the dispensed portion of the paper roll. The pressure roller may ensure that the paper from the paper roll moves with the spindle as the spindle rotates.

Known pressure rollers require a large number of components, such as torsion springs and coil springs. The components can require separate sourcing streams and time-consuming assembly. Thus, a dispenser with a reduced number of components would be useful.

SUMMARY

In general, the present disclosure is directed to a roller assembly for a dispenser. The roller assembly may include compliant mechanisms for pressure roller supports and a flapper bar. The compliant mechanisms may urge the pressure roller and the flapper bar in a desired direction, and the compliant mechanisms may elastically deform to urge the pressure roller and the flapper roller in the desired direction. The compliant mechanisms may be integral to the other components of the roller assembly, e.g., such that the compliant mechanisms and other portions of the roller assembly are formed from one seamless piece of material.

In one example embodiment, a roller assembly for a dispenser includes an elongated guide body and a pair of pressure roller supports. Each of the pair of pressure roller supports is positioned proximate an opposite end portion of the elongated guide body. A plurality of compliant support arms couple the pair of pressure roller supports to the elongated guide body. A plurality of compliant support spring members are configured to couple a flapper bar to the elongated guide body.

In a first example aspect, the elongated guide body, the pair of pressure roller supports, the plurality of compliant support arms, and the plurality of compliant support spring members may be integrally formed from a single, unitary piece of material. The single, unitary piece of material may a plastic body.

In a second example aspect, each of the pair of pressure roller supports may include a bearing mount defining a passage configured for receipt of a shaft of a pressure roller. The bearing mount on each of the pair of pressure roller supports may be positioned at a middle portion of each of the pair of pressure roller supports.

In a third example aspect, each of the pair of pressure roller supports may include at least two spring arms.

In a fourth example aspect, each of the plurality of compliant support spring members may include a triangular plastic spring.

In a fifth example aspect, the plurality of compliant support spring members may be configured to normally position the flapper bar such that the flapper bar covers a plurality of cutting teeth.

In a sixth example aspect, the roller assembly may not include a metallic coil spring or a metallic torsion spring.

In a seventh example aspect, the roller assembly may be incorporated into a dispenser. The dispenser may include a housing. A roll carrier may be disposed within the housing. The roll carrier may be configured for rotatably supporting a roll of web material for dispensing. The roller assembly may also be disposed within the housing. The roller assembly may be configured for engaging the roll of web material between the roll carrier and a free end of the roll of web material. The elongated guide body may be mounted to the housing.

Each of the example aspects recited above may be combined with one or more of the other example aspects recited above in certain embodiments. For instance, all of the seven example aspects recited above may be combined with one another in some embodiments. As another example, any combination of two, three, four, five, or six of the seven example aspects recited above may be combined in other embodiments. Thus, the example aspects recited above may be utilized in combination with one another in some example embodiments. Alternatively, the example aspects recited above may be individually implemented in other example embodiments. Accordingly, it will be understood that various example embodiments may be realized utilizing the example aspects recited above.

These and other features, aspects and advantages of the present disclosure will become better understood with reference to the following description and appended claims. The accompanying drawings, which are incorporated in and constitute a part of this specification, illustrate embodiments of the disclosure and, together with the description, serve to explain the principles of the disclosure.

BRIEF DESCRIPTION OF THE DRAWINGS

A full and enabling disclosure of the present disclosure, including the best mode thereof, directed to one of ordinary skill in the art, is set forth in the specification, which makes reference to the appended figures.

Figure 1:
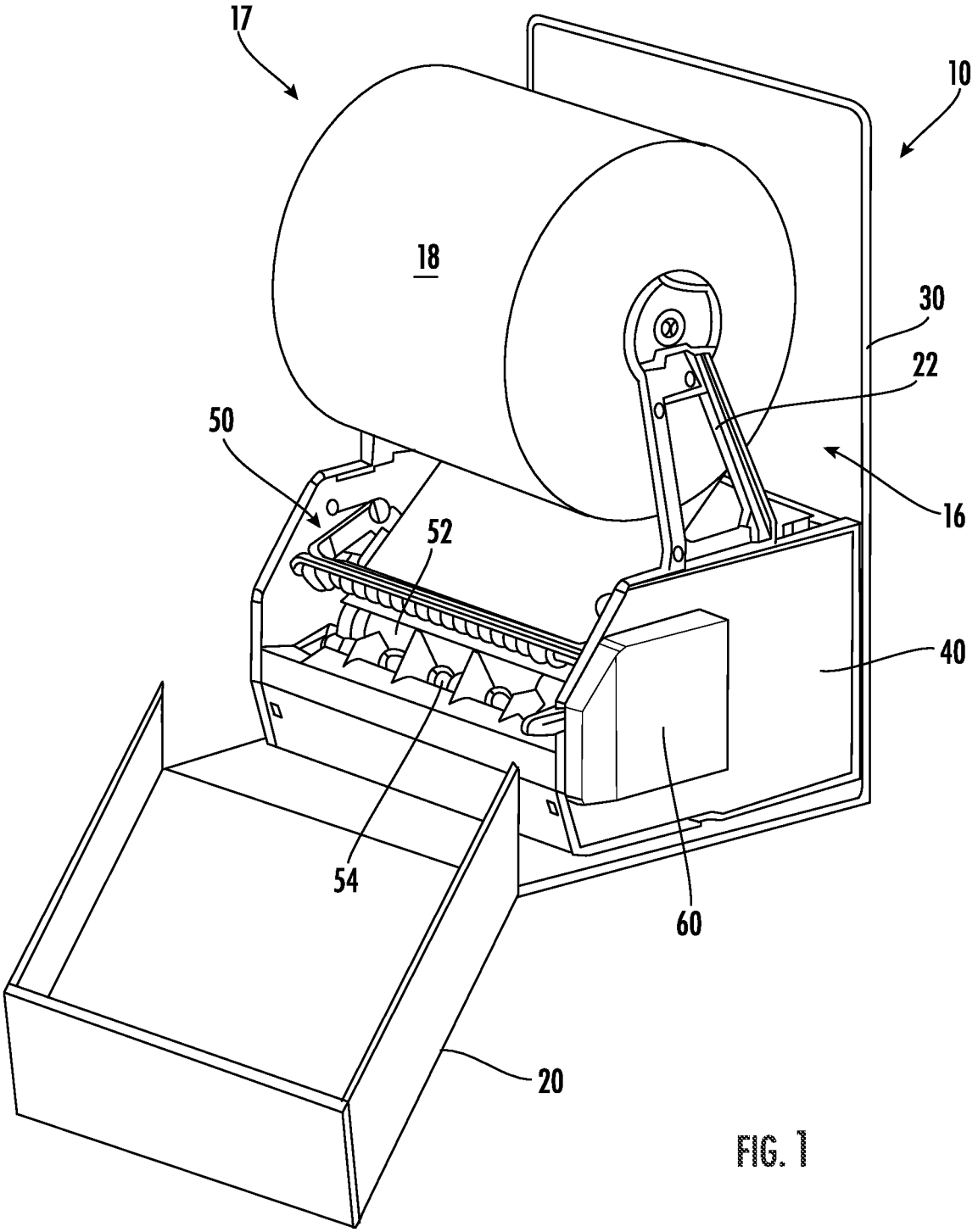
FIG. 1 is a perspective view of a dispenser with a roller assembly according to an example embodiment of the present disclosure.

Repeat use of reference characters in the present specification and drawings is intended to represent the same or analogous features or elements of the present invention.

DETAILED DESCRIPTION

It is to be understood by one of ordinary skill in the art that the present discussion is a description of exemplary embodiments only, and is not intended as limiting the broader aspects of the present disclosure.

As used herein, the terms "includes" and "including" are intended to be inclusive in a manner similar to the term "comprising." Similarly, the term "or" is generally intended to be inclusive (i.e., "A or B" is intended to mean "A or B or both"). Approximating language, as used herein throughout the specification and claims, is applied to modify any quantitative representation that could permissibly vary without resulting in a change in the basic function to which it is related. Accordingly, a value modified by a term or terms, such as "about," "approximately," and "substantially," are not to be limited to the precise value specified. In at least some instances, the approximating language may correspond to the precision of an instrument for measuring the value. For example, the approximating language may refer to being within a ten percent (10%) margin.

FIG. 1 illustrates an example embodiment of a dispenser 10 for dispensing a dispensable product in accordance with embodiments of the present disclosure. The dispenser 10, as shown, is configured for dispensing rolled sheet material products, such as rolled sheets of paper towels or toilet paper. The dispenser 10 is particularly suited for dispensing paper towels, tissues, and the like. Generally, the dispenser 10 is configured for dispensing multiple rolls of material. The dispenser is not limited to any particular type of roll material, or any particular application. The dispenser is illustrated in the figures as a paper towel roll dispenser for purposes of illustration only.

As shown in FIG. 1, the dispenser 10 includes a housing 16 having an interior volume 17 that is configured for housing one or more rolls of sheet material. For example, the housing 16 can be configured to house a first roll of sheet material 18 (e.g., a main roll) and/or a second roll of sheet material (e.g., a stub roll). The housing 16 may be formed of any suitable material or materials. The housing may take on any manner of shapes or configurations. Generally, the dispenser 10 may include a front cover assembly 20 and a backplate 30. The front cover assembly 20 is shown in an open position. In certain example embodiments, the front cover assembly 20 may define one or more of the sidewalls of the dispenser 10. In other example embodiments, however, the front cover assembly 20 may form at least a portion of the sidewalls of the dispenser. In other example embodiments, however, the front cover assembly 20 does not form any portion of the sidewalls of the dispenser. The front cover assembly 20 may be pivotally coupled to the backplate 30. For example, one or more hinges may pivotally couple the front cover assembly 20 to the backplate 30. Any conventional pivotal attaching mechanism may be used in this regard. For example, in certain example embodiments, a simple rotatable rod is provided and retained by rod holders. It should be appreciated that any number of conventional pivotal arrangements are known by those skilled in the art and may be utilized to pivotally mount the front cover assembly 20 to the backplate 30. In other example embodiments, the front cover assembly 20 may be completely removable or detachable from the backplate 30.

A module 40 may be provided in the interior volume 17, the module 40 houses a dispensing mechanism 50. Generally, the dispensing mechanism 50 includes components configured for dispensing sheet material from a roll. For example, the dispensing mechanism 50 may be configured to dispense sheet material from either a first roll and/or a second roll in a controlled manner. For example, the dispensing mechanism 50 may include any type of feed roller and/or nip roller arrangement for advancing sheet material from the roll of sheet material 18 through a dispensing opening. Generally, such feed roller arrangements, including control circuitry for operating said rollers, are known by those of skill in the art. Any known dispensing components may be used to dispense sheet material from the roll of sheet material 18.

The dispenser 10 also includes a roll retainer 22 configured to hold the roll of sheet material 18. While one roll retainer 22 is shown, the disclosure is not so limited. Indeed, any number of roll retainers 22 may be used or incorporated into the dispenser 10 disclosed herein. For example, in example embodiments where the dispenser 10 is configured to hold at least two rolls of sheet material 18, at least two roll retainers 22, such as a first roll retainer and a second roll retainer, may be used. In certain example embodiments, a first roll retainer may be used to hold a first roll of sheet material (e.g., a main roll) and a second roll retainer may be used to hold a second roll of sheet material (e.g., a stub roll). Roll retainers 22 are generally known in the art and are capable of supporting a roll of sheet material such that sheet material may be unrolled and dispensed via a dispensing opening in the dispenser. For example, certain roll retainers have an arm with a nub and/or hub thereon, the nub or hub may be inserted into the core diameter of the roll, thus allowing the roll to move circumferentially in order to dispense sheet material from the roll. Any known configurations of roll retainer may be used herein.

Figure 2:
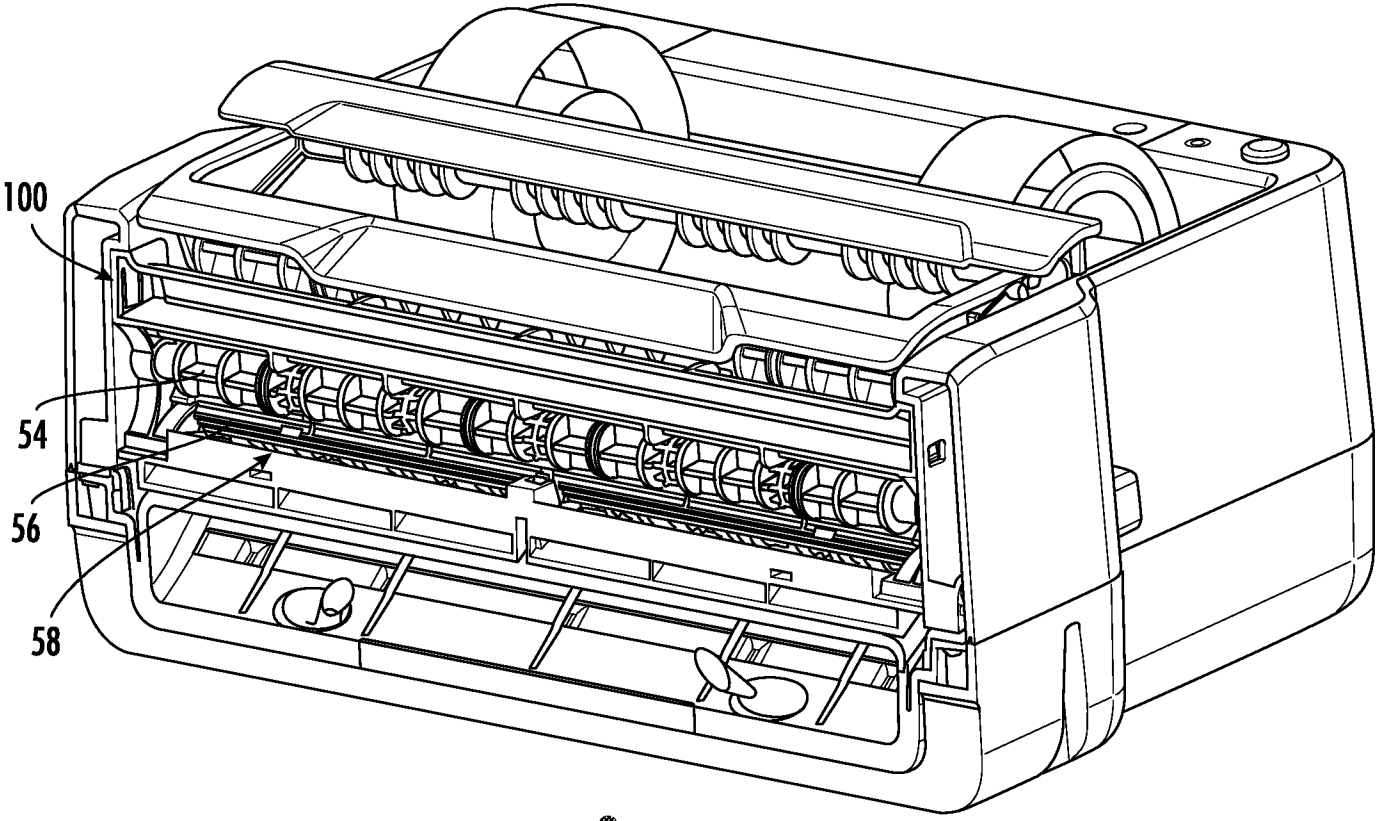
FIG. 2 is a partial; perspective view of a roller assembly according to an example embodiment of the present disclosure.

As shown in FIG. 2, the dispensing mechanism 50 may include a roller assembly 100. Roller assembly 100 is configured to assist with dispensing sheet material 18. For instance, roller assembly 100 may engage sheet material 18 between roll retainer 22 and a free end of sheet material 18. Moreover, roller assembly 100 may assist with urging a pressure roller 54 towards a driven spindle 52 (FIG. 1). Driven spindle 52 may be coupled to a motor (not shown) such that the motor may be operable to rotate driven spindle 52. Roller assembly 100 may assist with holding the sheet material 18 against driven spindle 52 in order to facilitate dispensing of sheet material 18 from dispenser 10 during rotation of driven spindle 52. As another example, roller assembly 100 may assist with urging a flapper bar 56 over cutting teeth 58. Roller assembly 100 may assist with holding flapper bar 56 in a normal position that covers cutting teeth 58 in order to prevent or limit sheet material 18 from sliding against cutting teeth 58 during rotation of driven spindle 52. However, when a user pulls sheet material 18 towards cutting teeth 58, flapper bar 56 may displace, and the sheet material 18 may impact against cutting teeth 58 to separate the free end of sheet material 18 from the remaining sheet material within dispenser 10. As discussed in greater detail below, roller assembly 100 may include compliant mechanisms for urge pressure roller 54 towards driven spindle 52, flapper bar 56 over cutting teeth 58, and/or urging other components of roller assembly 100 towards other components of dispenser 10.

Figure 3:
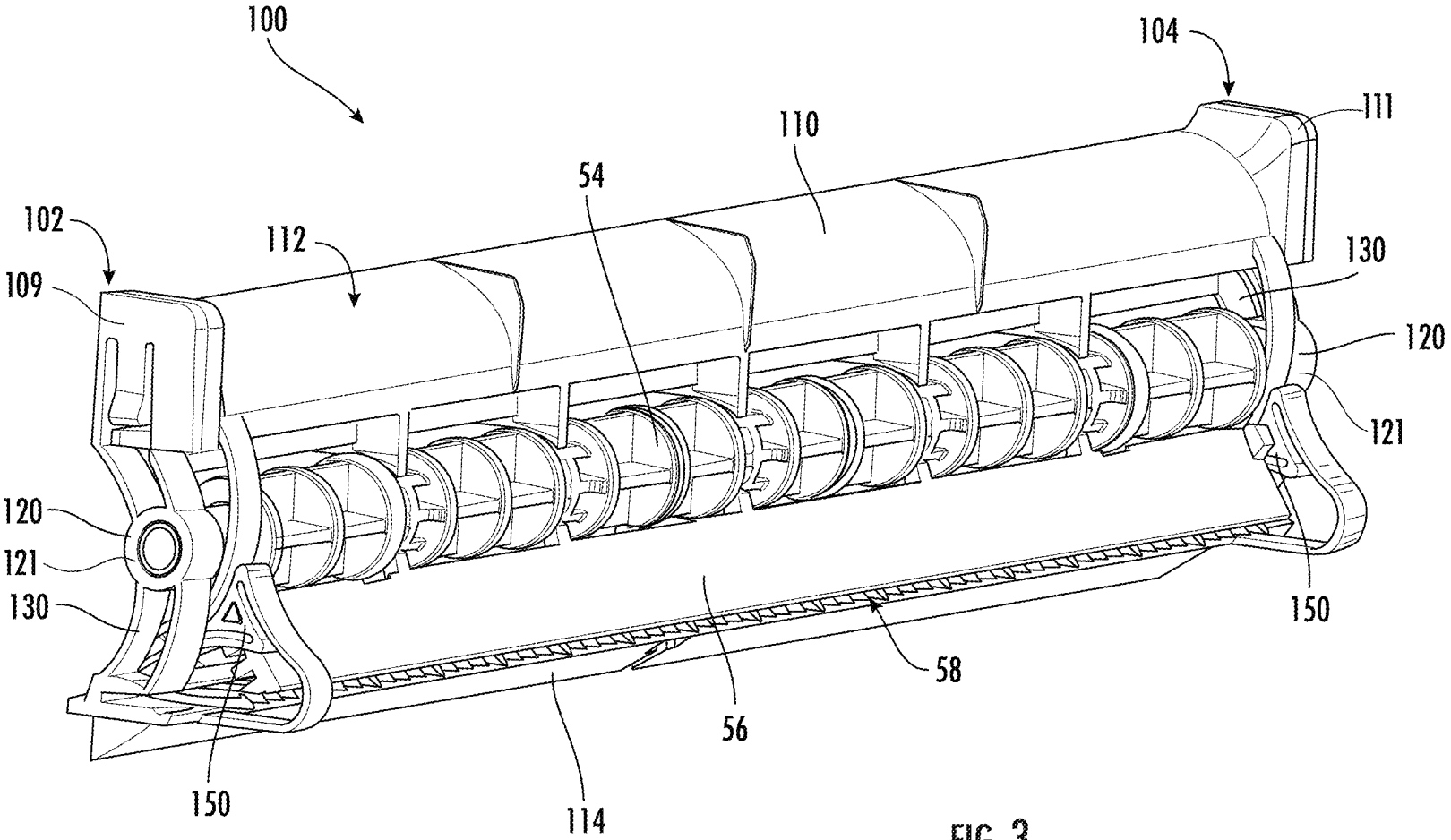
FIG. 3 is a perspective view of a roller assembly according to an example embodiment of the present disclosure.
Figure 4:
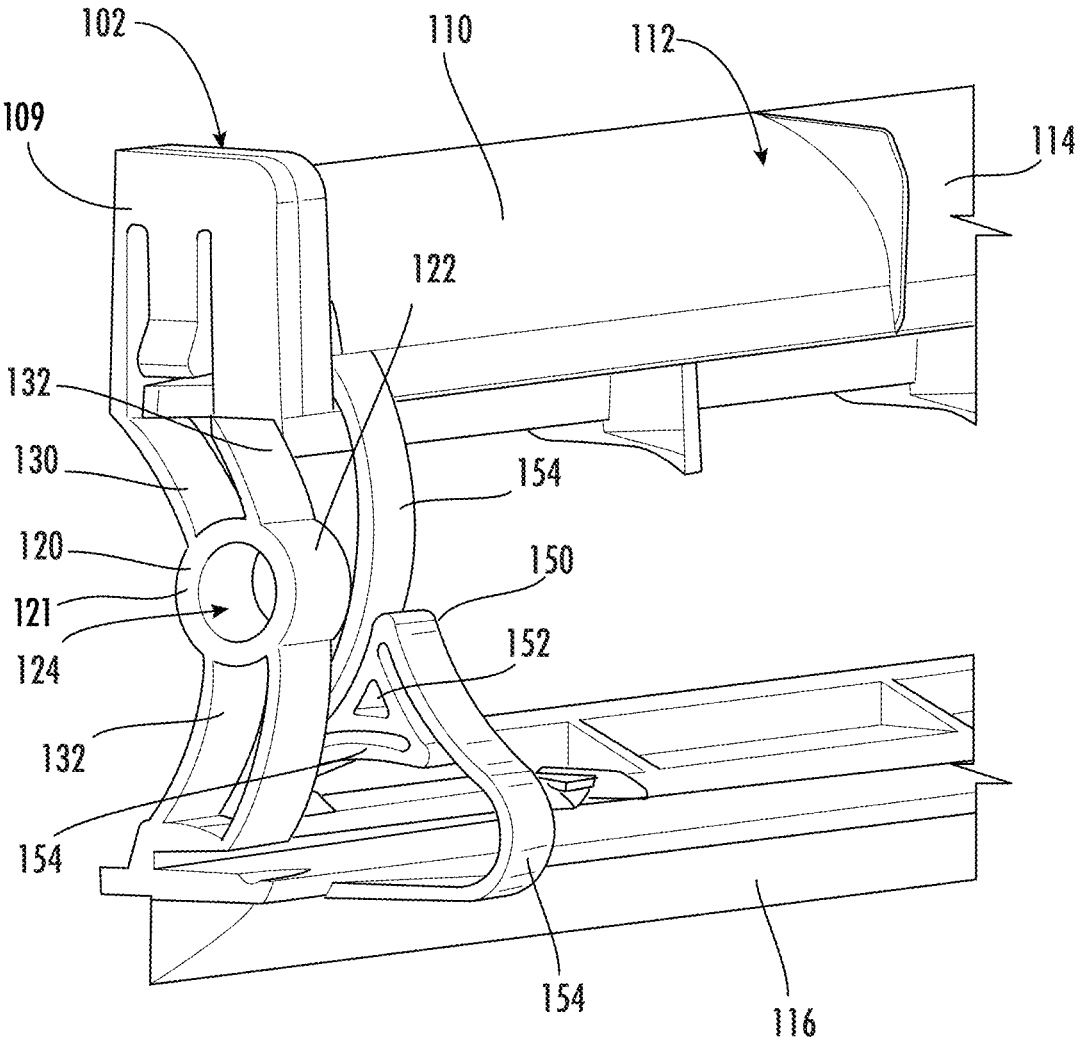
FIG. 4 is a partial; perspective view of a roller assembly according to an example embodiment of the present disclosure.

Turning now to FIGS. 3 and 4, example aspects of roller assembly 100 will be described in greater detail. As shown, roller assembly 100 may extend longitudinally between a first end portion 102 and a second end portion 104. In FIG. 4, only first end portion 102 of roller assembly 100 is shown. However, it will be understood that second end portion 104 of roller assembly 100 may be constructed in the same or similar manner. The length of roller assembly 100, e.g., between first and second end portions 102, 104 may be about equal to a width of housing 16. Thus, e.g., roller assembly 100 may extend across interior volume 17 between opposite sidewalls of housing 16. Moreover, e.g., the first end portion 102 of roller assembly 100 may be positioned at or proximate one sidewall of housing 16, and the second end portion 104 of roller assembly 100 may be positioned at or proximate the opposite sidewall of housing 16.

Roller assembly 100 may include an elongated guide body 110, pressure roller supports 120, compliant support arms 130, and compliant support spring members 150. Elongated guide body 110 may be mounted housing 16. During dispensing, sheet material 18 may slide over a guide surface 112 of elongated guide body 110. Thus, e.g., elongated guide body 110 may form at least a portion of a dispensing path for sheet material 18 through dispensing mechanism 50. Elongated guide body 110 may also form a mounting structure for other components of roller assembly 100. Roller assembly 100 may further include an upper body portion 114 and a lower body portion 116. Upper body portion 114 may define guide surface 112 and form the portion of the dispensing path for sheet material 18 through dispensing mechanism 50 described above. Lower body portion 116 may also form a mounting structure for components of roller assembly 100, such as cutting teeth 58. Thus, e.g., flapper bar 56 may be positioned over at least a portion of lower body portion 116. Moreover, pressure roller 54 and flapper bar 56 may be disposed between upper and lower body portions 114, 116. Upper and lower body portions 114, 116 may be integrally formed from single piece of material, such as injection molded plastic or additively formed plastic, as described in greater detail below.

Roller assembly 100 may include two or more pressure roller supports 120, e.g., positioned at opposite end portions 109, 111 of elongated guide body 110. Pressure roller supports 120 are configured for rotatably mounting supporting pressure roller 54. For instance, pressure roller supports 120 may include a bearing mount 122 that defines a passage 124. Passage 124 is configured for receipt of a shaft of pressure roller 54. For instance, the shaft of pressure roller 54 may be received within passage 124 and rotate on bearing mount 122. Bearing mount 122 may be positioned at a middle portion 121 of pressure roller support 120.

Pressure roller 54 may be positioned generally parallel to elongated guide body 110. Compliant support arms 130 may couple elongated guide body 110 to pressure roller supports 120. Compliant support arms 130 may be a compliant mechanism for pressure roller 54. Thus, e.g., compliant support arms 130 may elastically deform to urge pressure roller 54 towards driven spindle 52. In certain example embodiments, compliant support arms 130 may include at least two spring arms 132. Spring arms 132 may extend from upper body portion 114 to pressure roller supports 120, e.g., and to lower body portion 116. Spring arms 132 may be curved or arcuate, e.g., concave or complementary to guide surface 112 of elongated guide body 110. Bearing mount 122 may be positioned at the middle portion of spring arms 132 between upper and lower body portions 114, 116.

Flapper bar 56 may be positioned generally parallel to elongated guide body 110. As noted above, flapper bar 56 may be configured to cover cutting teeth 58. Thus, e.g., to separate a dispensed portion of sheet material 18 from dispenser 10, a user may grasp the sheet material 18 hanging from beneath the housing 16 and pull the sheet material 18 forward to displace flapper bar 56 and expose cutting teeth 58 such that the free end of sheet material 18 separates from the remaining roll of sheet material 18 within dispenser 19.

Compliant support spring members 150 may couple flapper bar 56 to elongated guide body 110. Compliant support spring members 150 may be a compliant mechanism for flapper bar 56. Thus, e.g., compliant support spring members 150 may elastically deform to urge flapper bar 56 towards a normal position to cover cutting teeth 58. In certain example embodiments, compliant support spring members 150 may include a triangular plastic spring 152. Triangular plastic spring 152 may include three spring legs 154. A first one of spring legs 154 of triangular plastic spring 152 may extend from upper body portion 114 to triangular plastic spring 152, a second one of spring legs 154 of triangular plastic spring 152 may extend lower body portion 116 to triangular plastic spring 152, and a third one of spring legs 154 of triangular plastic spring 152 may also extend from lower body portion 116 to triangular plastic spring 152. Opposite ends of flapper bar 56 may be mounted to each triangular plastic spring 152.

Elongated guide body 110, pressure roller supports 120, compliant support arms 130, and compliant support spring members 150 may be integrally formed from a single, unitary piece of material. For instance, elongated guide body 110, pressure roller supports 120, compliant support arms 130, and compliant support spring members 150 may be injection molded, additively formed, etc. from a single, seamless piece of material. The material may be a plastic in certain example embodiments. As noted above, compliant support arms 130 and compliant support spring members 150 may be compliant mechanisms for roller assembly 100, e.g., and elastically deform during operation of dispenser 10. By utilizing compliant support arms 130 and compliant support spring members 150, roller assembly 100 may advantageously avoid or omit metallic coil springs and/or metallic torsion springs. Thus, e.g., roller assembly 100 may be a single piece construction such that dispensing mechanism 50 advantageously has significantly less parts than known dispensing mechanisms.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

REFERENCE CHARACTERS

10 dispenser
16 Housing
17 Interior volume
18 Sheet material
20 Front cover assembly
22 Roll retainer
30 Backplate
40 Module
50 Dispensing mechanism
52 Driven spindle
54 Pressure roller
56 Flapper bar
58 Cutting teeth
100 Roller assembly
102 First end portion of roller assembly
104 Second end portion of roller assembly
109 First end portion of elongated guide body
110 Elongated guide body
111 Second end portion of elongated guide body
112 Guide surface
114 Upper body portion
116 Lower body portion
120 Pressure roller supports
121 Middle portion
122 Bearing mount
124 Passage
130 Compliant support arms
132 Spring arms
150 Compliant support spring members
152 Triangular plastic spring
154 Spring legs

EXAMPLE EMBODIMENTS

First example embodiment: A roller assembly for a dispenser, includes an elongated guide body; a pair of pressure roller supports, each of the pair of pressure roller supports positioned proximate an opposite end portion of the elongated guide body; a plurality of compliant support arms coupling the pair of pressure roller supports to the elongated guide body; and a plurality of compliant support spring members configured for coupling a flapper bar to the elongated guide body.

Second example embodiment: The roller assembly of the first example embodiment, wherein the elongated guide body, the pair of pressure roller supports, the plurality of compliant support arms, and the plurality of compliant support spring members integrally formed from a single, unitary piece of material.

Third example embodiment: The roller assembly of the second example embodiment, wherein the single, unitary piece of material is constructed of plastic.

Fourth example embodiment: The roller assembly of any one of the first through third embodiments, wherein each of the pair of pressure roller supports includes a bearing mount defining a passage configured for receipt of a shaft of a pressure roller.

Fifth example embodiment: The roller assembly of any one of the fourth embodiment, wherein the bearing mount on each of the pair of pressure roller supports is positioned at a middle portion of each of the pair of pressure roller supports.

Sixth example embodiment: The roller assembly of any one of the first through fifth embodiments, wherein each of the pair of pressure roller supports comprises at least two spring arms.

Seventh example embodiment: The roller assembly of any one of the first through sixth embodiments, wherein each of the plurality of compliant support spring members comprises a triangular plastic spring.

Eighth example embodiment: The roller assembly of any one of the first through seventh embodiments, wherein the plurality of compliant support spring members are configured to normally position the flapper bar over a plurality of cutting teeth.

Nineth example embodiment: The roller assembly of any one of the first through eighth embodiments, wherein the roller assembly does not include a metallic coil spring or a metallic torsion spring.

Tenth example embodiment: A dispenser, includes a housing; a roll carrier disposed within the housing, the roll carrier configured for rotatably supporting a roll of web material for dispensing; and a roller assembly disposed within the housing, the roller assembly configured for engaging the roll of web material between the roll carrier and a free end of the roll of web material, the roller assembly includes an elongated guide body mounted to the housing, a pair of pressure roller supports, each of the pair of pressure roller supports positioned proximate an opposite end portion of the elongated guide body, a plurality of compliant support arms coupling the pair of pressure roller supports to the elongated guide body, and a plurality of compliant support spring members configured to couple a flapper bar to the elongated guide body.

Eleventh example embodiment: The dispenser of the tenth embodiment, wherein the elongated guide body, the pair of pressure roller supports, the plurality of compliant support arms, and the plurality of compliant support spring members integrally formed from a single, unitary piece of material.

Twelfth example embodiment: The dispenser of the eleventh embodiment, wherein the single, unitary piece of material is constructed of plastic.

Thirteenth example embodiment: The dispenser of any one of the tenth through twelfth embodiments, further comprising a pressure roller, each of the pair of pressure roller supports comprises a bearing mount defining a passage that receives a shaft of the pressure roller.

Fourteenth example embodiment: The dispenser of the thirteenth embodiment, wherein the bearing mount on each of the pair of pressure roller supports is positioned at a middle portion of each of the pair of pressure roller supports.

Fifteenth example embodiment: The dispenser of any one of the tenth through fourteenth embodiments, wherein each of the pair of pressure roller supports comprises at least two spring arms.

Sixteenth example embodiment: The dispenser of any one of the tenth through fifteenth embodiments, wherein each of the plurality of compliant support spring members comprises a triangular plastic spring.

Seventeenth example embodiment: The dispenser of any one of the tenth through sixteenth embodiments, further comprising a plurality of cutting teeth, the plurality of compliant support spring members configured to normally position the flapper bar to cover the plurality of cutting teeth.

Eighteenth example embodiment: The dispenser of any one of the tenth through seventeenth embodiments, wherein the roller assembly does not include a metallic coil spring or a metallic torsion spring.

What is claimed:

1. A roller assembly for a dispenser, comprising:

an elongated guide body;

a pair of pressure roller supports, each of the pair of pressure roller supports positioned proximate a respective opposite end portion of the elongated guide body;

a plurality of compliant support arms coupling the pair of pressure roller supports to the elongated guide body; and a plurality of compliant support spring members configured for coupling a flapper bar to the elongated guide body, wherein the elongated guide body, the pair of pressure roller supports, the plurality of compliant support arms, and the plurality of compliant support spring members are integrally formed from a single, unitary piece of material.

2. The roller assembly of claim 1, wherein the single, unitary piece of material is constructed of plastic.

3. The roller assembly of claim 1, wherein each of the pair of pressure roller supports comprises a bearing mount defining a passage configured for receipt of a shaft of a pressure roller.

4. The roller assembly of claim 3, wherein the bearing mount on each of the pair of pressure roller supports is positioned at a middle portion of each of the pair of pressure roller supports.

5. The roller assembly of claim 1, wherein each of the pair of pressure roller supports comprises at least two spring arms.

6. The roller assembly of claim 1, wherein each of the plurality of compliant support spring members comprises a triangular plastic spring.

7. The roller assembly of claim 1, wherein the plurality of compliant support spring members are configured to normally position the flapper bar over cutting teeth.

8. The roller assembly of claim 1, wherein the roller assembly does not include a metallic coil spring or a metallic torsion spring.

9. A dispenser, comprising:

a housing;

a roll carrier disposed within the housing, the roll carrier configured for rotatably supporting a roll of web material for dispensing; and a roller assembly disposed within the housing, the roller assembly configured for engaging the roll of web material between the roll carrier and a free end of the roll of web material, the roller assembly comprising an elongated guide body mounted to the housing, a pair of pressure roller supports, each of the pair of pressure roller supports positioned proximate a respective opposite end portion of the elongated guide body, a plurality of compliant support arms coupling the pair of pressure roller supports to the elongated guide body, and a plurality of compliant support spring members coupling a flapper bar to the elongated guide body, wherein the elongated guide body, the pair of pressure roller supports, the plurality of compliant support arms, and the plurality of compliant support spring members are integrally formed from a single, unitary piece of material.

10. The dispenser of claim 9, wherein the single, unitary piece of material is constructed of plastic.

11. The dispenser of claim 9, further comprising a pressure roller, each of the pair of pressure roller supports comprises a bearing mount defining a passage that receives a shaft of the pressure roller.

12. The dispenser of claim 11, wherein the bearing mount on each of the pair of pressure roller supports is positioned at a middle portion of each of the pair of pressure roller supports.

13. The dispenser of claim 9, wherein each of the pair of pressure roller supports comprises at least two spring arms.

14. The dispenser of claim 9, wherein each of the plurality of compliant support spring members comprises a triangular plastic spring.

15. The dispenser of claim 9, further comprising a plurality of cutting teeth, the plurality of compliant support spring members configured to normally position the flapper bar to cover the plurality of cutting teeth.

16. The dispenser of claim 9, wherein the roller assembly does not include a metallic coil spring or a metallic torsion spring.

* * * * *